United States Patent [19]

Pfülb et al.

[11] 4,369,214

[45] Jan. 18, 1983

[54] PROCESS AND APPARATUS FOR PREVENTING HARDENING OF GLUE ON INACTIVE BOTTLE LABELING MACHINE

[75] Inventors: Manfred Pfülb; Rudolf Zodrow, both of Düsseldorf, Fed. Rep. of Germany

[73] Assignee: Jagenberg Werke Ag, Düsseldorf, Fed. Rep. of Germany

[21] Appl. No.: 261,436

[22] Filed: May 8, 1981

[30] Foreign Application Priority Data

May 14, 1980 [DE] Fed. Rep. of Germany ..... 3018356
Jun. 12, 1980 [DE] Fed. Rep. of Germany ..... 3022040

[51] Int. Cl.[3] ..... B05D 1/28; B65C 9/16; B65C 9/22; B65C 9/42

[52] U.S. Cl. ..... 427/428; 15/256.51; 118/203; 118/231; 118/261; 156/351; 156/357; 156/364; 156/389; 156/568; 156/571; 156/578; 156/DIG. 32; 156/DIG. 35; 156/DIG. 45; 271/33

[58] Field of Search ..... 156/357, 389, 567, 568, 156/571, 578, 351, 364, DIG. 32, DIG. 35, DIG. 45; 222/402.12; 118/203, 302, 231, 261; 427/428; 118/231, 261; 15/256.51, 320, 415 R; 271/33

[56] References Cited

U.S. PATENT DOCUMENTS

| | | | |
|---|---|---|---|
| 2,718,870 | 9/1955 | McFarland | 118/203 |
| 3,800,702 | 4/1974 | Roberts | 118/203 |
| 4,019,217 | 4/1977 | Schinke | 118/203 |
| 4,279,687 | 7/1981 | Buchholz et al. | 156/568 |

FOREIGN PATENT DOCUMENTS

| | | | |
|---|---|---|---|
| 2632332 | 1/1978 | Fed. Rep. of Germany | 156/567 |

*Primary Examiner*—Michael G. Wityshyn
*Attorney, Agent, or Firm*—Sprung, Horn, Kramer & Woods

[57] ABSTRACT

In the cleaning and keeping ready for use the labeling station of a labeling machine comprising a label box, a glue roll and a gripper cylinder as well as label pickup members rolling along the glue roll, wherein the glue is removed from the surface of the glue roll after the supply of glue to the glue roll has been shut off and with the machine idling, the improvement which comprises moisturizing the glue roll after the supply of glue has been shut off.

An apparatus thereof is provided comprising a spray head associated with the glue roll or a pickup member. It may be used in conjunction with a bottle filling machine provided with sensors to actuate the spray head in response to the absence or backup of bottles to be filled.

16 Claims, 5 Drawing Figures

PROCESS AND APPARATUS FOR PREVENTING HARDENING OF GLUE ON INACTIVE BOTTLE LABELING MACHINE

BACKGROUND OF THE INVENTION

The invention relates to a labeling machine for objects, and more particularly for bottles, which comprises conveying means for the objects; a revolving carrier having at least one label pickup member mounted thereon to rotate or oscillate; and stations disposed about said carrier, these being a gluing station, a label supply station and a label transfer station with which the pickup member or members cooperate, the gluing station consisting of a revolving glue roll, a deactivatable glue applicator, and an engageable glue scraper.

A labeling machine of this type is known from Application Ser. No. 72,378, filed Sept. 4, 1979, now U.S. Pat. No. 4,279,687. In that labeling machine a second glue scraper is provided which permits the thickness of the glue layer to be adjusted. However, that glue scraper is mounted along with the glue applicator on a pivotable carrier. An angular displacement of the carrier causes the glue applicator, constructed as a slot nozzle, to be moved away from the glue-roll surface, the application of glue thus being interrupted; and that same displacement also serves to position the glue scraper so that it bears tangentially on the glue roll. The function of the glue scraper then is to scrape off the glue still on the roll. Since the pickup members continue to roll along the glue-roll surface, they retransfer glue to the glue-roll surface, which means that the pickup members, too, may indirectly be freed of glue in this way.

However, it has been found that scraping the glue-roll surface completely dry, and allowing the pickup surfaces of the pickup members to dry completely, has certain disadvantages. While the major drawback of the machine being fouled by glue that is thrown off is then overcome, there is no preventing the edges of the pickup surfaces of the pickup members from becoming encrusted with drying glue, with the result that the pickup surfaces are enlarged, glue then being transferred also to areas on the objects being labeled where it is not needed and where it is an eyesore. Besides, with completely dry surfaces there will be more friction and hence increased wear.

A remedy resorted to in practice has been to cover the machine with moist towels during interruptions of operation, such as breaks, in order to minimize surface drying, and/or to clean the machine at the end of the break. But this is a primitive and onerous way of keeping the machine ready for use.

A further problem encountered in operating that labeling machine is that after an extended interruption of operation, for example, when starting work in the morning, the cold pickup members will not readily pick up the warm glue from the glue roll, and the labels carried by the pickup members are not readily picked off by the gripper cylinder. This means that the machine cannot be brought up to speed right away. But optimum glue-handling conditions are important also during operation. When the atmosphere is too dry or the pickup members are too warm or too cold, then the glue, which may be casein-based, for example, will set prematurely, depending on its grade (casein glue, for example, or dextrin glue), so that in the course of time a glue layer builds up on the pickup members that becomes steadily thicker. This will result in imprecise application of glue to the pickup members, which will have an adverse effect on the pickup of labels from the label stack.

SUMMARY OF THE INVENTION

Since it is often necessary to let the machine idle, as, for example, during inspection and startup, and operation is interrupted also for other reasons, such as breaks, etc., the invention has as its object to provide a labeling machine which can be idled for an extended period of time without this resulting in deleterious glue encrustations or increased wear, and with which operation can then be resumed practically without delay.

In accordance with the invention, this object is accomplished in that spray heads for water or another medium for moisturizing or diluting the glue which are adapted to be turned on and off are associated with the glue roll or the pickup member or members to permit the glue-roll cylinder surface or the pickup surfaces of the pickup members to be sprayed.

While in the machine in accordance with the invention the glue feed is also stopped when the machine is idling, as it is in the prior-art labeling machine, the surfaces of both the glue roll and the pickup members are kept moist so that these surfaces are really freed of glue completely and the glue will not build up on them in the course of time to form a crust and/or encrust the edges of these surfaces. The moisture on these surfaces further acts as a lubricating film that will prevent premature wear of elements rolling on or rubbing against one another. Moreover, since these surfaces are kept moist, the machine is always ready for use, and after an interruption of operation the labeling of bottles can therefore be resumed without a "warm-up" time.

To permit the number of positioning elements for retracting the glue applicator and advancing the glue scraper to be kept to a minimum, the disengageable glue applicator and the engageable glue scraper in one embodiment of the invention are mounted on a common carrier in such a way that an angular displacement of the carrier will move the glue applicator away from and the scraper toward the glue roll.

The spray head associated with the glue roll is preferably disposed behind the scraper, in the direction of rotation of the glue roll. The spraying medium will then be able to act longer and will get on the pickup surface of the pickup member without first having to pass the scraper.

It is not necessary that the glue-roll cylinder be sprayed continuously. Preferably the spray head or heads can be turned on in spurts for at least the length of time that it takes all of the pickup members to roll along the glue roll. With this arrangement, the pickup surfaces of the pickup members need not be sprayed anew with spraying medium every time they roll along the glue roll. A continuous feed of spraying medium, which is collected much like the glue, would eventually cause the glue to be diluted by the spraying medium.

The spray heads associated with the pickup members are preferably disposed in the center of the carrier or beyond the carrier between the stations. In this case, too, provision may be made for the spray heads to be turned on in spurts for at least the length of time that the pickup surfaces of the pickup members are facing them.

Since the basic speed of rotation of the machine due to the main drive usually is too high for keeping the machine in the standby mode, it is a further feature of the invention that an auxiliary drive is associated with the main drive of the labeling machine in such a way that the rotative speed of the labeling machine is reduced to inching when the auxiliary drive is engaged. Such coupling can be realized by means of an overriding clutch, for example. The various control actions may be initiated as a function of the passage of the bottles by means of a control system that can be used both with a labeling machine and with a bottle filling machine preceding it and combined with it and driven by a main drive in synchronism with the labeling machine. With such a control system, there are disposed along the conveying path of the bottle filling machine a first sensor for backed-up bottles as well as a bottle hold-back device, and along the conveying path between the filling machine and the labeling machine a second sensor responsive to individual bottles or to a gap in the row of bottles; and along the conveying path downstream of the labeling machine a third sensor for backed-up bottles, with the first sensor in the presence of backed-up bottles switching the machine combination to full speed and in the absence of backed-up bottles actuating the bottle hold-back device and switching the machine combination to reduced speed, the third sensor in the presence of backed-up bottles actuating the bottle hold-back device regardless of the action initiated by the first sensor and switching the machine combination to reduced speed, and the second sensor in the presence of a gap causing the label pickup to be interrupted, for example, by retracting the label box, shutting off the glue supply, and initiating moistening. With this control system, the sequence of the various control actions can be adapted to the operating requirements by means of timing elements. In the case of a combination of labeling machine and bottle filling machine, for example, the bottle hold-back device is actuated at full machine speed and the machine speed is reduced only after the bottles have left the bottle filling machine. In the case of a labeling machine, on the other hand, the machine speed is reduced first, to assure gentle handling of the bottles, and the bottle hold-back device is actuated only then. Since the gap sensor is located at a very specific point, a time element may be employed to assure that the labeling means are deactivated only after the last bottle has passed the labeling station.

A further object of the invention is a method of cleaning and keeping ready for use the labeling station of a labeling machine comprising a label box, a glue roll and a gripper cylinder as well as label pickup members rolling along the glue roll, particularly in a labeling machine of the type described above, in which the glue is removed from the surface of the glue roll, in particular by scraping, after the supply of glue to the glue roll has been shut off and with the machine idling. With such a method, the labeling machine is cleaned and kept ready for use by scraping the glue roll free of glue and moistening it after the supply of glue has been shut off. This can be done by spraying the glue roll or the pickup members. Moistening is preferably done in spurts.

The object of the invention can further be accomplished by maintaining an atmosphere about the pickup member and/or the glue roll, by spraying or blowing a wet and/or heated or cooled medium onto them, which permits optimum handling of the labels.

The invention thus is based on recognition of the fact that in the long run the pickup members will properly pick up the warm glue, and the labels to be carried by the pickup members from the label box to the gripper cylinder can be readily picked off the pickup members only, when the pickup members are at a temperature which while precluding premature setting of the warm glue, which may be casein-based, for example, assures the transfer of a sufficient amount of glue to the pickup members. Since the pickup members may be at too low or too high a temperature before the machine is started, or even while it is in operation, it may be necessary to heat them or to cool them. Since in contrast to the prior-art methods, where the pickup members, with the glue feed turned on, are heated by the glue being transferred from the glue roll to the pickup members, in the invention the pickup members are heated directly or indirectly through the heated glue roll, with the glue supply shut off, the machine can be turned on without risking that it may be fouled by glue that is thrown off. When the pickup members are heated, the machine can immediately be run at full speed. Because of the precisely adjustable humid atmosphere, the glue will not begin to dry during operation.

Since the labeling station is usually disposed under a hood, maintaining the desired atmosphere poses no difficulties. It is also possible to provide within the hood sensors for the atmosphere and to regulate the infeed of medium on the basis of the measurements made. The medium may be fed in through the spray head or heads for the moisturizing medium or through additional nozzles. To prevent contamination of the glue by the spraying medium, a spraying medium that is compatible with the glue is used.

Moreover, it is advantageous to spray also the gripper cylinder.

BRIEF DESCRIPTION OF THE DRAWINGS

The invention will now be described with reference to the accompanying drawings illustrating embodiments thereof, wherein.

DETAILED DESCRIPTION OF THE INVENTION

Figure 1:
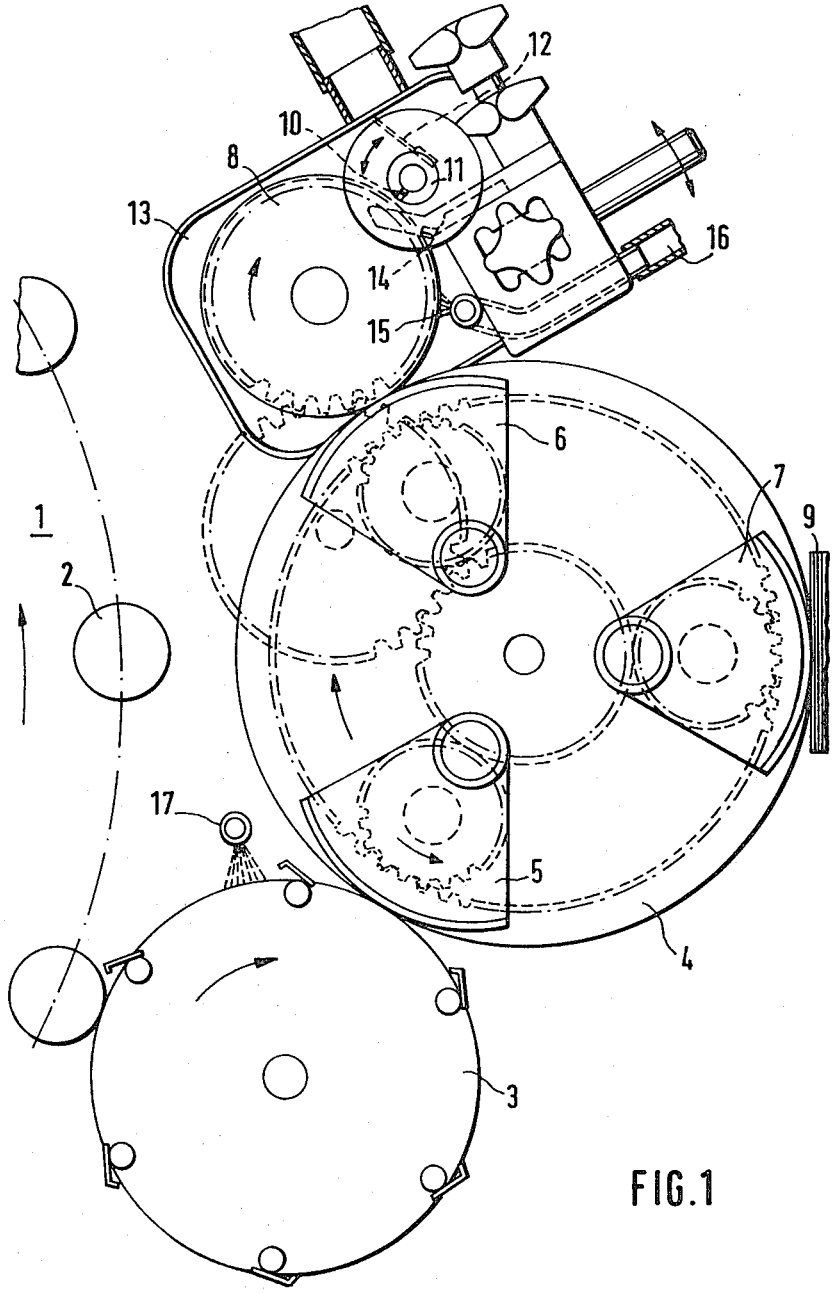
FIG. 1 is a diagrammatic top plan view of a labeling machine having a spray head associated with the glue roll.

On a bottle carrier 1 constructed as a turret, bottles 2 are moved past a gripper cylinder 3 which affixes labels to them.

On a revolving carrier 4, a plurality of pickup members 5, 6 and 7 are rotatably mounted. Bottle turret 1, gripper cylinder 3, pickup-member carrier 4, pickup members 5 to 7 and a glue roll 8 are driven in synchronism by a common drive (not shown). The pickup surface of each pickup member rolls along the glue-coated surface of the glue roll, picks up from a label box 9 by adhesive action a label, which is thus coated with glue on its back, and transfers it to the gripper cylinder 3, which affixes it to one of the bottles 2.

Associated with the glue roll 8 is an applicator 10 in the form of a nozzle slot or a series of nozzle orifices in a glue feed pipe 11. Mounted on the latter is a glue scraper 12. The glue feed pipe 11 can be rotated about its own axis so that the slotlike nozzle of the glue applicator is moved away from the cylinder of the glue roll 8 and in its place the glue scraper 12 is brought to bear on said cylinder. In this way, the application of glue can be stopped without the supply of glue being shut off. The glue which continues to be fed in flows into a catch basin 13. An adjustable doctor blade 14 determines the thickness of the glue layer.

Between the pickup members 5, 6 and 7 and the glue applicator 10, scraper 12 and doctor blade 14, there is further associated with the glue roll 8 a spray head 15 in the form of a slot nozzle or series of nozzle orifices which is directed toward the glue-roll cylinder. Through the spray head, spraying medium can be sprayed onto the glue-roll cylinder. Valves (not shown) in a feed pipe 16 permit the feed to be turned on in spurts.

A spray head 17 is associated also with the gripper cylinder 3. Spraying medium can be fed to that spray head, too, in spurts by means of valves (not shown).

Figure 2:
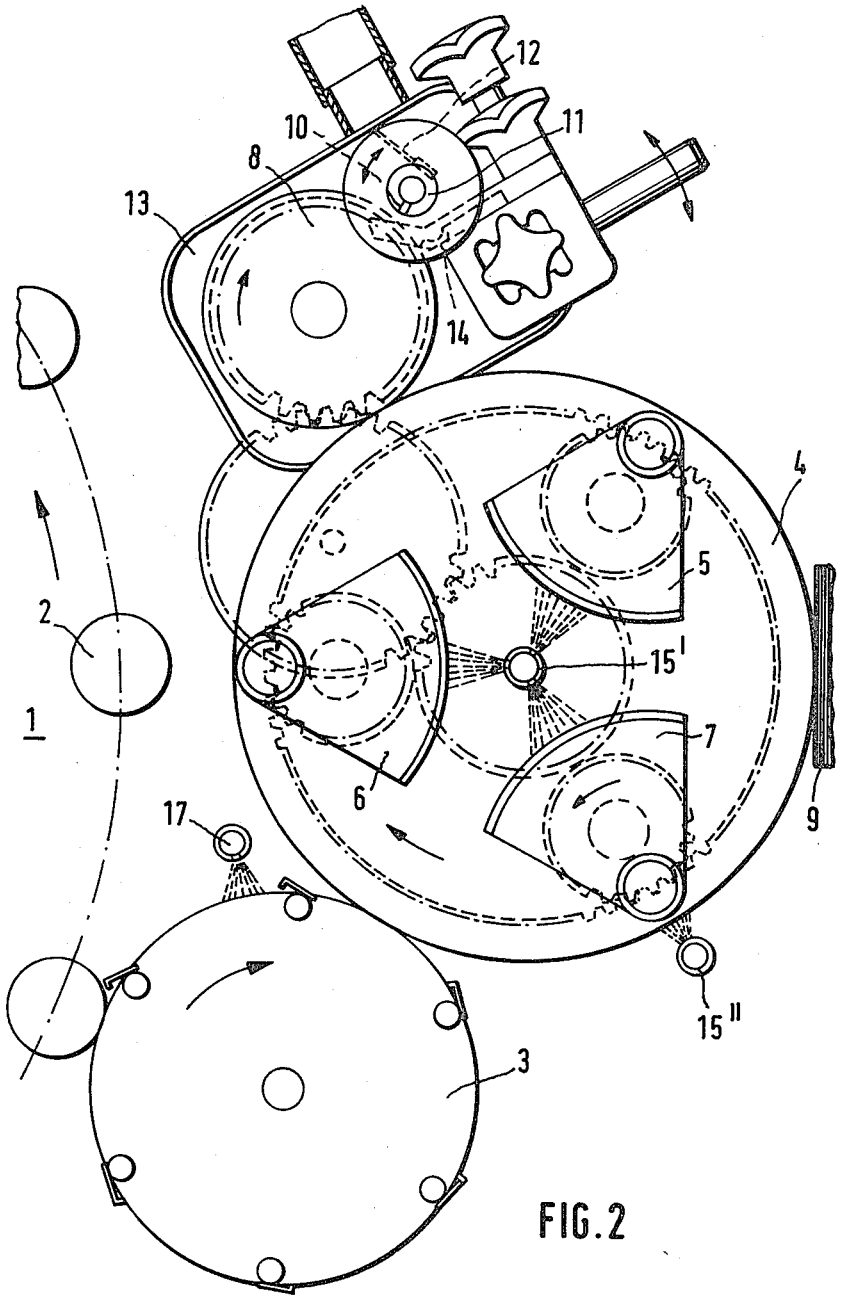
FIG. 2 is a diagrammatic top plan view of a labeling machine having spray heads associated with the pickup members.

The embodiment shown in FIG. 2 differs from that of FIG. 1 only in that in place of the spray head 15 there is provided on the carrier 4 a spray head 15' having three radially spraying nozzle slots or series of nozzle orifices. However, it is also possible, and in the case of oscillating pickup members even advantageous, to locate a spray head 15'' beyond the carrier 4 between the stations 3, 4 and 8. In that case, too, the spraying medium may be supplied in spurts through a valve (not shown) inserted in the feed pipe.

Figure 3:
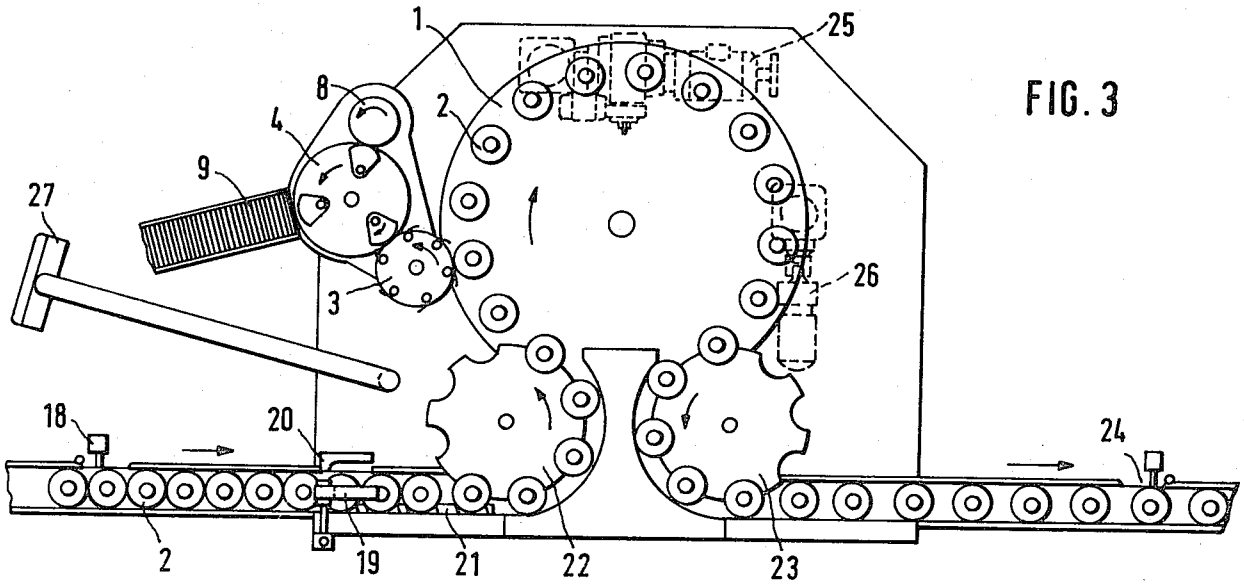
FIG. 3 is a diagrammatic top plan view of a labeling machine with conveying means for the bottles.

The embodiment according to FIG. 3 comprises, apart from the labeling station 3 to 17 with the turret 1 for the bottles 2, conveying means provided with sensors for the control system. The bottles first pass a first sensor 18 which is responsive to backed-up bottles, and then a second sensor 19 responsive to gaps in the row of bottles. In proximity to the sensor 19 there is provided, moreover, a bottle hold-back device 20 adapted to detain bottles. Located in the vicinity of the second sensor 19 there is further one end of a spacer worm 21 which spaces the bottles arriving in a closed row apart by a distance corresponding to the spacing of the peripheral pockets of an infeed starwheel 22. The latter transfers the bottles to the turret. From the turret the bottles are transferred through an outfeed starwheel 23 to a conveying path where a third sensor 24 responsive to backed-up bottles is provided.

The spacer worm 21, the infeed starwheel 22, the turret 1, the labeling station 3, 4 and 8, and the outfeed starwheel 23 are driven in synchronism by a common drive consisting of a main drive motor 25 and an auxiliary drive motor 26. The main drive motor 25 and the auxiliary drive motor 26 are coupled to each other through an overriding clutch in such a way that when the main drive motor 25 is turned on the auxiliary drive motor 26 is unable to run. Associated with the labeling machine is, moreover, a control console 27.

To keep the pickup members at the temperature necessary for satisfactory handling of the heated casein glue, or to raise them to that temperature, hot water or steam may be fed to the spray head or heads 15, 17 and 15'. In the case of short interruptions of operation, the hot water then also serves to keep the labeling machine ready for use.

Figure 5:
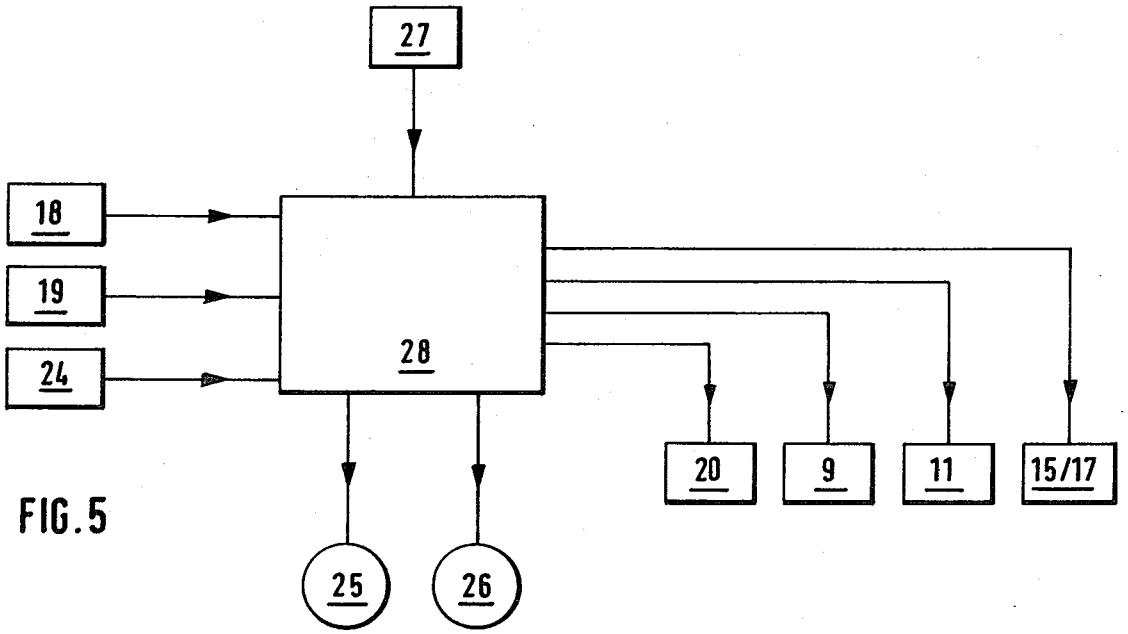
FIG. 5 is a block diagram of a control system for a labeling machine.

FIG. 5 shows the control system. The sensors 18, 19 and 24 and the manually operated control console 27 deliver commands to a control unit 28 which controls the main drive motor 25, the auxiliary drive motor 26, the positioning elements for the bottle hold-back device 20, the label box 9, the glue feed pipe 11 and the spray head 15 or heads 15' and 15''. The control unit 28 processes the commands delivered by the sensors 18, 19 and 24 and by the control console 27 in such a way that in the case of backed-up bottles reported by the third sensor 24 the machine speed is reduced by turning off the main drive motor 25. Once the machine is running at low speed, the bottle hold-back device 20 is actuated. The label box and the glue applicator continue to be actuated for a while in order that even the last bottle passing the labeling station may be labeled. Then the glue roll 8 is freed of glue by rotating the glue applicator 10 out of engagement and the glue scraper 12 into engagement with said roll, which is then kept moist by turning on the spray head 15.

As soon as the sensor 24 ceases to detect backed-up bottles, the machine is brought up to speed again. The bottles are released by the bottle hold-back device 20. The spray head 15 is turned off and the application of glue is resumed.

When sensor 18 reports the absence of backed-up bottles, the machine is controlled in a similar manner as when a backup is reported by sensor 24. The machine speed is then reduced and the bottle hold-back device 20 is actuated at low machine speed. The gap which develops is reported by sensor 19, with the result that after a given time delay the label box 9, the glue applicator 10 and the scraper 12 are repositioned. As soon as backed-up bottles are detected by sensor 18, the bottle hold-back device is deactivated and the bottles again reach the labeling station without any gaps. Sensor 19 then reports the head end of a new row of bottles, with the result that after an appropriate time delay the spray head 15 is turned off, the glue applicator 10 brought into engagement, the label box advanced and the machine again brought up to speed.

To prevent collision between commands, the backup sensor 24 is assigned priority over the sensor 18.

Figure 4:
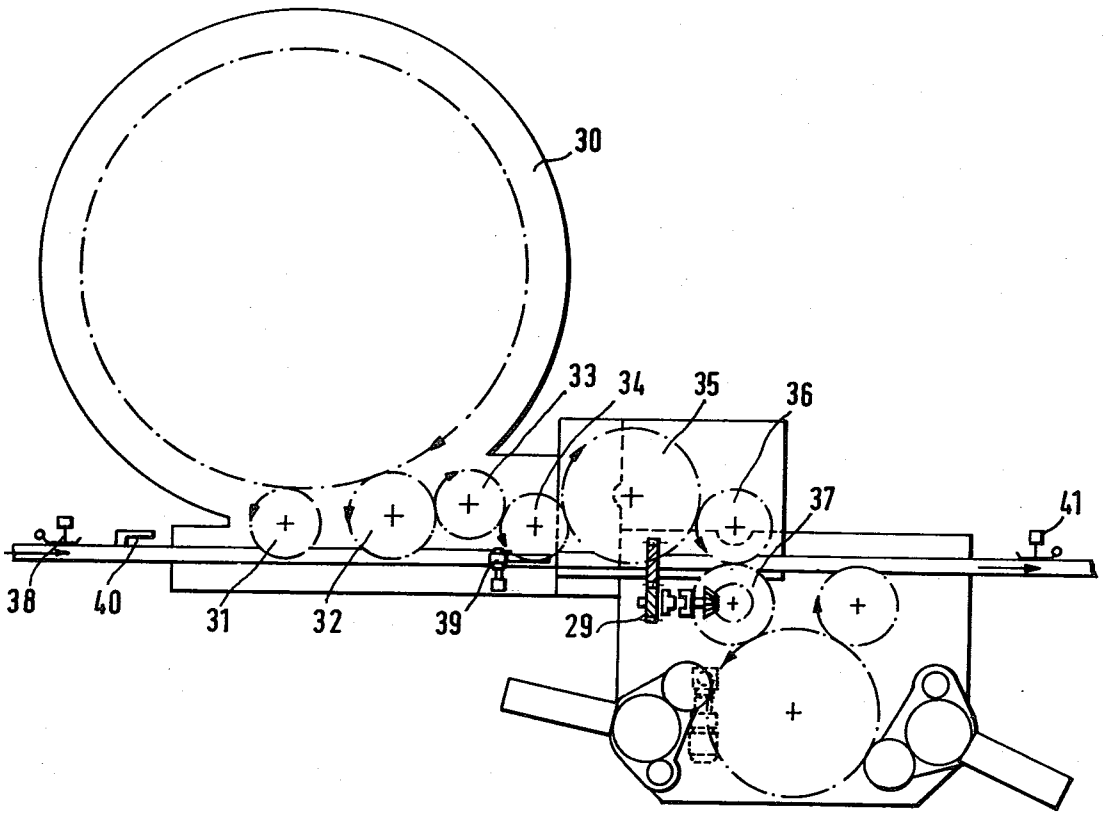
FIG. 4 is a diagrammatic top plan view of a labeling machine combined with a bottle filling machine and conveying means for the bottles.

In the embodiment shown in FIG. 4, a bottle filling machine 30 precedes the labeling machine shown in FIG. 3. Through an infeed starwheel 31, the bottles reach the filling machine 30, constructed as a turret, and through an outfeed starwheel 32 and a plurality of intermediate starwheels 33 to 36 are fed to infeed starwheel 37 of the labeling machine. The bottle filling machine 30, the starwheels 31 to 36 and the labeling machine are driven in synchronism by a common drive. However, to permit the labeling machine to be run also independently, for maintenance and repair purposes, a clutch 29 is provided.

In this combination, too, a sensor 38 responsive to backed-up bottles is provided at the entrance to the filling machine 30, and a sensor 39 responsive to gaps between bottles is disposed between the filling machine 30 and the labeling machine. Ahead of the filling machine 30 there is further provided a bottle hold-back device 40. A third sensor 41 is located at the discharge end of the labeling machine. The sensors 38, 39 and 41 correspond with respect to their functions to the sensors 18, 19 and 24 of the labeling machine of FIG. 3 while the bottle hold-back device 40 corresponds to bottle hold-back device 20. The only difference in the control sequence is that in the filling machine/labeling machine combination the bottle hold-back device 40 is actuated while the machine still runs at full speed, and that the machine speed is reduced only then, since satisfactory filling of the bottles can be secured only with the machine running at full speed.

For example, to make the machine ready for use in the morning before the start of production, the feed of heated medium is initiated from the control console 27, the automatic control system being turned off. However, such medium may be fed in also during production in order to maintain the labeling station under an optimum atmosphere for the handling of the labels.

It will be appreciated that the instant specification and claims are set forth by way of illustration and not of limitation, and that various changes and modifications may be made without departing from the spirit and scope of the present invention.

What is claimed is:

1. In the cleaning and keeping ready for use the labeling station of a labeling machine comprising a label box, a glue roll and a gripper cylinder as well as label pickup members rolling along the glue roll, wherein the glue is removed from the surface of the glue roll after the supply of glue to the glue roll has been shut off and with the machine idling, the improvement which comprises moisturizing the glue roll after the supply of glue has been shut off so as to keep the glue roll wet throughout idling.

2. A method according to claim 1, wherein moisturizing is effected by spraying the glue roll or the pickup members.

3. A method according to claim 1, wherein with the glue feed turned on or off predetermined atmospheric conditions are maintained about the pickup member and/or the glue roll, by spraying or blowing a wet and/or cooled medium onto them.

4. A method according to claim 3, wherein the medium is heated water, steam or air.

5. A method according to claim 1, wherein moisturizing is effected in spurts.

6. A method according to claim 1, wherein a spraying medium is used that is compatible with the glue.

7. A method according to claim 1, wherein the gripper cylinder is sprayed.

8. In a labeling machine for objects such as bottles and comprising a main drive, conveying means for the objects, a revolving carrier having at least one label pickup member mounted thereon to rotate or oscillate, a gluing station, a label supply station and a label transfer station disposed about said carrier, the pickup member cooperating with the stations, the gluing station comprising a revolving glue roll, a deactivatable glue applicator and an engageable glue scraper adapted to be brought into operating position, a first spray head associated with the glue roll or with a pickup member, moisturizing means for delivering water or another medium to the spray head, and means for turning the spray head on and off so as to spray the cylinder surface of the glue roll or the pickup surface of the pickup member with water or other medium for moisturizing or diluting the glue on the receiving surface, the improvement which comprises an additional spray head for water or another medium for moisturizing or diluting the glue positioned adjacent the label transfer station, and additional means for turning the additional spray head on and off.

9. A labeling machine according to claim 8, wherein the glue applicator and the engageable glue scraper are mounted on a common carrier in such a way that an angular displacement of the carrier will move the glue applicator away from the glue roll and the scraper toward the glue roll.

10. A labeling machine according to claim 8, wherein the first spray head is associated with the glue roll and is disposed behind the scraper in the direction of rotation of the glue roll.

11. A labeling machine according to claim 8, wherein the first spray head is associated with the glue roll and is adapted to be turned on in spurts for at least the length of time taken by all pickup members to roll along the glue roll.

12. A labeling machine according to claim 8, wherein the first spray head is associated with a pickup member and is disposed in the center of the carrier.

13. A labeling machine according to claim 8, wherein the first spray head is associated with a pickup member and is disposed beyond the revolving carrier between the gluing station, label supply station and label transfer station.

14. A labeling machine according to claim 13, wherein the first spray head is adapted to be turned on in spurts for at least the length of time that the pickup surfaces of the pickup members face the spray head.

15. A labeling machine according to claim 8, including a main drive for the labeling machine, and an auxiliary drive associated with the main drive of the labeling machine in such a way that the speed of rotation of the labeling machine can be changed over to inching by turning on the auxiliary drive.

16. A control system for a labeling machine according to claim 8 in combination with a bottle filling machine which precedes it and is driven in synchromism with the labeling machine from a main drive, including a first sensor disposed along the conveying path to the bottle filling machine for sensing backed-up bottles, a bottle hold-back device, a second sensor along the conveying path between the bottle filling machine and the labeling machine responsive to individual bottles or to gaps in a row of bottles, and a third sensor along the conveying path downstream of the labeling machine for sensing backed-up bottles, the first sensor in the presence of backed-up bottles switching the machine combination to full speed, and in the absence of backed-up bottles actuating the hold-back device and switching the machine combination to reduced speed, the third sensor in the presence of backed-up bottles actuating the bottle hold-back device regardless of the action initiated by the first sensor and switching the machine combination to reduced speed, and the second sensor in the presence of a gap in the row of bottles interrupting the pickup of labels, shutting off the glue supply, and turning on the moisturizing means.

* * * * *